United States Patent [19]

Vizziello

[11] 3,992,838

[45] Nov. 23, 1976

[54] INSULATED WALL LOG

[75] Inventor: Vito M. Vizziello, Hamden, Conn.

[73] Assignee: New England Log Homes, Inc., Hamden, Conn.

[22] Filed: July 14, 1975

[21] Appl. No.: 595,590

[52] U.S. Cl. ..... 52/233; 52/309; 52/404

[51] Int. Cl.[2] ..... E04B 1/10

[58] Field of Search ..... 52/233, 404, 405, 410, 52/309

[56] References Cited

UNITED STATES PATENTS

| | | | |
|---|---|---|---|
| 2,403,934 | 7/1946 | Lindstrom | 52/233 |
| 2,416,162 | 2/1947 | Drake | 52/233 |
| 3,552,079 | 1/1971 | Mortensen | 52/233 X |

FOREIGN PATENTS OR APPLICATIONS

| | | | |
|---|---|---|---|
| 1,068,293 | 5/1967 | United Kingdom | 52/405 |

*Primary Examiner*—Price C. Faw, Jr.
*Assistant Examiner*—Carl D. Friedman
*Attorney, Agent, or Firm*—DeLio and Montgomery

[57] ABSTRACT

A building construction element in the form of an insulated wood log with flat planed upper and lower surfaces, a longitudinally extending groove being cut into each surface to a depth about half the thickness of the log, the grooves being on opposite sides of the vertical medial plane of the log, and each groove being filled with a foamed plastic mass having thermal insulating properties substantially equivalent to those of polyurethane plastics.

7 Claims, 4 Drawing Figures

INSULATED WALL LOG

BACKGROUND OF THE INVENTION

This invention relates to a building construction element in the form of a wood log with flat planed upper and lower surfaces, a longutudinally extending groove being cut into each surface to a depth about equal to half the thickness of the log, the grooves being on opposite sides of the vertical medial plane of the log and each groove being filled with a foamed plastic, such as polyurethane, having thermal insulating properties which are superior to those of solid wood. The flat surfaces may be provided with smaller longitudinally extending grooves or kerfs, in the medial plane, to receive splines for ensuring accurate assembly of vertical arrays of logs and for initially sealing the horizontal cracks between superimposed logs.

In the construction of a building wall by the superposition of prepared logs, it is desirable to increase the thermal insulating qualities of the logs themselves, because the surfaces of the wall are normally not intended to receive insulation. This invention is directed to an insulating wall log for use as a construction material in the fabrication of log homes and similar structures in which wooden logs function as both structural and insulating building materials. A principal feature of the invention is the provision of grooves cut vertically in the flat top and bottom surfaces of the log on opposite sides of a vertical plane running lengthwise along the center of the log, which grooves are thereafter filled with foamed polyurethane or the like. Optionally, spikes may be driven horizontally through the log and filled groove to stabilize the structure.

It is an object of the invention to increase the insulating capabilities of the log by removing certain portions of the wood material and replacing them with a synthetic material having superior insulating properties.

It is another object of the invention to effect such a substitution of plastic for wood without impairing the structural integrity of the log.

It is a further object of the invention to provide such a log in which there is the equivalent of a constant thickness of supplemental insulating material, without resorting to a plastic sandwich construction.

It is a still further object of the invention to provide certain improvements in the form, construction, arrangement and materials of the several features of the combination by which the above named and other objects may effectively be attained.

It is known to provide built-up construction elements resembling logs by forming a plastic sandwich, faced on each surface by a wooden plank; it is also known to seal the horizontal or vertical cracks between logs by means of plastic strips, which arrangement has little or no thermal benefits.

The invention accordingly comprises an article of manufacture possessing the features, properties, and the relation of elements which will be exemplified in the article hereinafter described, and the scope of the invention will be indicated in the claims.

Practical embodiments of the invention are shown in the accompanying drawing, wherein.

Figure 1:
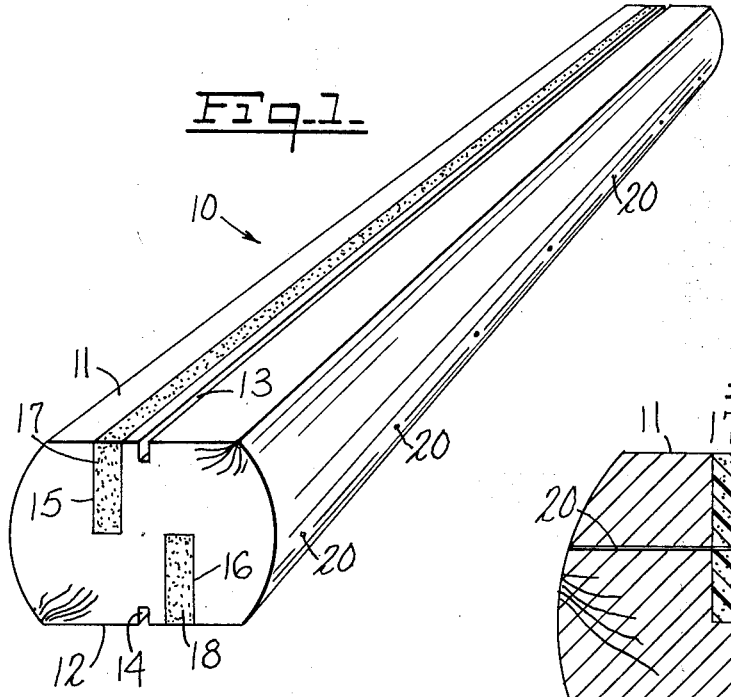
FIG. 1 represents a perspective view of a log with insulation-filled groves.

Referring to the drawings, a natural wood log 10 is normally de-barked, then sawed and planed to form flat parallel upper and lower faces 11, 12, each provided with a medially disposed longitudinal groove or kerf 13, 14. A wider and deeper groove 15, 16 is cut into each planed face, adjacent and parallel to the kerfs 13, 14, the grooves 15, 16 being on opposite sides of the vertical plane through the kerfs and each groove extending approximately half way through the log. As orders of magnitude, the wall logs shown in FIGS. 1 and 2 usually average 9 inches in diameter with variations between 7 inches minimum and 11 inches maximum, the kerfs 13, 14 being one-half inch wide and the grooves 15, 16 being one inch wide. The logs being about 6 inches thick, each groove has a depth of about 3 inches. These stated dimensions are by way of example, only, and may be varied as circumstances dictate or suggest.

Each of the grooves is filled with a suitable foamed plastic 17, 18, preferably foamed in situ to ensure good adhesion and complete filling of the space, and the stability and rigidity of the combination may be further aided by the provision of ties in the form of headless metal spikes or pins 20, driven horizontally into the sides of the log at suitable intervals and passing through the plastic at a level of slightly less than half the depth of the groove. Long screws could be substituted for the spikes with the same stabilizing effect but at a higher cost.

Figure 2:
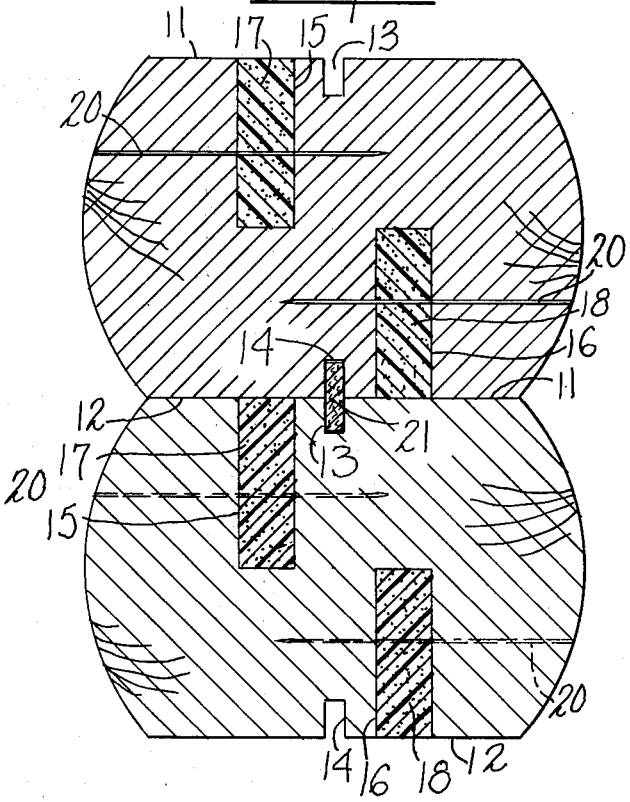
FIG. 2 represents a vertical transverse section through two logs, one superimposed on the other.

Proper vertical alignment of the logs, and basic sealing of the horizontal cracks between them, is effected by the provision of splines 21, designed to fit in the kerfs of adjacent logs as shown in FIG. 2.

Figure 3:
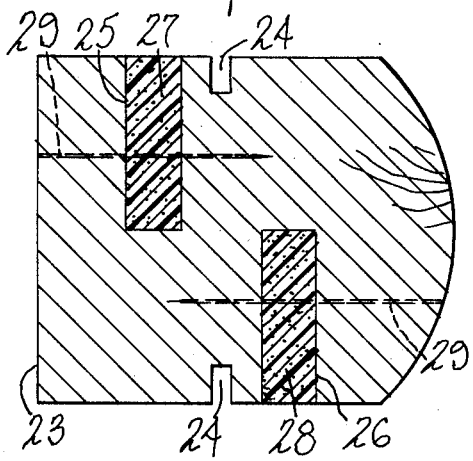
FIG. 3 represents a vertical transverse section through a modified form of log, specifically, a sill log.
Figure 4:
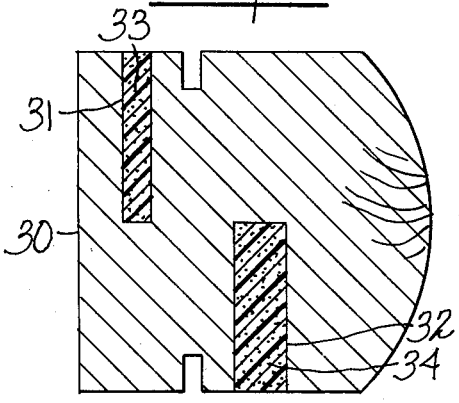
FIG. 4 represents a vertical transverse section through a second modified form of log, specifically, a so-called A-log.

At certain locations in the building it is necessary to have logs with at least one flat vertical face, as shown in FIGS. 3 and 4. The sill log 22 in FIG. 3 has a sawed and planed face 23 spaced 3 inches from the center line of the kerf 24, with grooves 25, 26 containing foamed plastic 27, 28 and metal spikes 29, all as described above. In the A-log of FIG. 4 the sawed and planed face 30 is only 2 inches from the center line of the kerf and the groove 31 is accordingly narrowed to one-half inch while groove 32 remains the full one inch wide and both are filled with foamed plastic 33, 34 as before. Spikes are not shown but may be used.

In each of the logs shown herein the inner ends of the filled grooves are at least one inch apart so that the integrity of the log is not impaired and the foamed plastic, particularly urethane base plastics, is rigid, durable, strongly adhesive, fire resistant and characterized by excellent thermal insulating qualities. ($R = 9.09$ in a typical urethane foam.) Wood, though somewhat insulating, is generally a better conductor of heat than urethane; by providing plastic foam inlays, disposed as shown, the heat path through the log is attenuated, made tortuous and thus elongated, resulting in substantially improved insulation. Wherever the horizontal thickness of the log is less than maximum, a plastic barrier to horizontal heat transfer is encountered. In each log shown the maximum horizontal thickness is substantially greater than the vertical thickness, so that a wall built as in FIG. 2 has excellent thermal insulating qualities.

Urethane base plastics are particularly suitable because of their insulating, bonding and fire-resistant qualities, but other materials such as polyethylene, ABS, polypropylene and polystyrene are adapted for foaming and could be used.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

What I claim is:

1. A building construction element comprising a solid natural wood log having flat parallel upper and lower surfaces adapted for engagement with surfaces of adjacent construction elements, a longitudinal groove extending inwardly from each said surface, the median planes of the grooves being substantially perpendicular to the planes of said surfaces, said median planes of the grooves being spaced laterally of the log and each groove having a depth equal to approximately half the distance between said surfaces, and each groove being filled with a body of foamed plastic having thermal insulating qualities superior to those of the wood.

2. A building construction element according to claim 1 wherein each said surface is provided with a longitudinally extending kerf lying in a plane between the planes of the grooves.

3. A building construction element according to claim 2 wherein the kerf is equidistant from the planes of the grooves.

4. A building construction element according to claim 1 which includes elongated metal ties driven through each plastic body and extending into the wood adjacent thereto.

5. A building construction element according to claim 1 wherein the side surfaces of the log having substantially their natural curvature and the planes of the grooves are spaced substantially equally from respective opposite side surfaces.

6. A building construction element according to claim 1 wherein one side surface of the log has substantially its natural curvature and the opposite side surface is substantially flat and perpendicular to the upper and lower surfaces.

7. A building construction element according to claim 1 wherein the maximum transverse horizontal dimension of the log is substantially greater than the distance between the upper and lower surfaces.

* * * * *